United States Patent [19]

Turtschan

[11] Patent Number: 5,001,886

[45] Date of Patent: Mar. 26, 1991

[54] PACKAGING MACHINE FOR THE ASEPTIC PACKAGING OF STERILE FILLINGS IN CUPS OR THE LIKE

[75] Inventor: Alfons Turtschan, Schwäbisch Hall, Fed. Rep. of Germany

[73] Assignee: Gasti Verpackungsmachinen GmbH, Schwabisch Hall, Fed. Rep. of Germany

[21] Appl. No.: 465,689

[22] Filed: Jan. 16, 1990

[30] Foreign Application Priority Data

Jan. 23, 1989 [DE] Fed. Rep. of Germany ..... 3901853

[51] Int. Cl.[5] ..... B65B 31/02; B65B 61/28

[52] U.S. Cl. ..... 53/167; 53/393

[58] Field of Search ..... 53/86, 110, 167, 282, 53/393; 198/468.2, 468.8; 414/217

[56] References Cited

U.S. PATENT DOCUMENTS

| | | | |
|---|---|---|---|
| 3,503,182 | 3/1970 | Phipps | 53/282 |
| 3,859,774 | 1/1975 | Bausch | 53/167 |
| 3,965,656 | 6/1976 | Gerben | 53/282 |
| 4,045,945 | 9/1977 | Möller et al. | 53/282 X |
| 4,151,698 | 5/1979 | Möller et al. | 53/282 X |
| 4,266,111 | 5/1981 | Trillwood | 414/217 X |
| 4,296,068 | 10/1981 | Hoshino . | |

FOREIGN PATENT DOCUMENTS

| | | |
|---|---|---|
| 0275346 | 5/1987 | European Pat. Off. . |
| 2509611 | 9/1976 | Fed. Rep. of Germany . |

*Primary Examiner*—Robert L. Spruill
*Assistant Examiner*—Daniel B. Moon
*Attorney, Agent, or Firm*—Herbert Dubno

[57] ABSTRACT

A packaging machine having a sterile tunnel is provided with an outlet gate at the downstream end into which a ram lifts the filled cups. Since the gate opening is always partly obstructed by a cup and as each cup is lifted into the opening by the limited stroke of the ram a cup previously obstructing the opening is removed, the losses of air through the opening are limited and pressure fluctuations in the tunnel are reduced.

20 Claims, 3 Drawing Sheets

PACKAGING MACHINE FOR THE ASEPTIC PACKAGING OF STERILE FILLINGS IN CUPS OR THE LIKE

CROSS REFERENCE TO RELATED APPLICATION

This application is related to the commonly assigned copending application Ser. No. 463,040 filed Jan. 10, 1990.

BACKGROUND OF THE INVENTION

My present invention relates to an apparatus for the aseptic packaging of sterile fillings, such as food products, in cups or the like in appropriate filling and package-closure machines utilizing a sterile tunnel through which the packages are conveyed and which is maintained at a superatmospheric pressure of sterile air. More particularly, the invention relates to an outlet gate for such a tunnel through which the filled and closed sterile packages can be removed from the machine by lifting them from a conveyor on which the cups are transported through the tunnel.

BACKGROUND OF THE INVENTION

Packaging machines, also described as filling and package-closing machines, for the aseptic packaging of food products, for example, and provided with a tunnel maintained under sterile conditions by a superatmospheric pressure of sterile air are known, for example, from French Patent 2,120,765.

Such machines can have a plurality of working stations including, for example, a station in which cups are set into cells or pockets of a conveyor carrying the cups along a transport path through the sterile tunnel, a station at which unit quantities or metered doses of the food product are placed in the cups, and a station in which a lid is placed on the cup to seal the package.

The tunnel of the system described in the French patent application is provided at its downstream end with an outlet gate which is formed with a relatively large opening in the sterile tunnel wall.

A lifting ram or plunger is juxtaposed with this opening to lift the filled up from the cup transporter or conveyor, e.g. a cell chain, so that the free end of the ram is disposed at a level above the gate opening and at the level of a table on which the filled cups are carried away.

When the cup is lifted to this level on the ram, a slider can shift the cup from the ram onto the table.

Because the ram must extend, in this system, considerable above the gate opening of the tunnel, the opening through which air can escape is substantial. With the raising and lowering of the ram, therefore, the sterile tunnel is subjected to air pressure fluctuations which have a detrimental effect on the measuring devices in the tunnel which are responsive to air pressure and serve to control the sterilizing pressure excess. Thus control of the sterile conditions may be a problem.

Furthermore, with even momentary development of large outflow cross sections, there is a significant danger that contaminating microorganisms can be entrained into the tunnel in spite of the sterile air over pressure.

Finally it may be mentioned that the relatively large flow cross section of the outlet gate requires the use of large volumes of sterile air at significant energy cost.

OBJECTS OF THE INVENTION

It is, therefore, the principal object of the present invention to provide a filling and package closing machine of the aforedescribed type which can reduce the consumption of sterile air to a significant degree without increasing the danger of microorganism contamination in the tunnel.

Another object of the invention is to provide an improved discharge gate which allows, with relatively simple means, the sterile air pressure to be held largely constant, thereby avoiding drawbacks of prior art systems.

It is a further object of the invention to provide a packaging machine of the aforedescribed type with an improved, simple and efficient discharge gate.

SUMMARY OF THE INVENTION

These objects and others which will become apparent hereinafter are attained, in accordance with the present invention in a packaging machine which comprises:

means for defining a sterile tunnel maintained at a superatmospheric pressure of sterile air and through which filled cups are displaceable to a discharge end of the tunnel;

a cup conveyor displaceable in the tunnel for carrying the filled cups to the discharge end;

an outlet gate formed above the conveyor at the outlet end having an opening dimensioned to pass a filled cup but to be substantially blocked by a filled cup in the opening;

a lifting ram in the tunnel aligned with the opening for lifting filled cups in succession from the conveyor into the opening, the lifting ram having a stroke limited to enable each filled cup removed from the conveyor to be lifted into the opening to thereby substantially block the opening while a filled cup previously retained in the opening is lifted to a position above the filled cup substantially blocking the opening;

means for releasably retaining the filled cup substantially blocking the opening in the opening until another filled cup is displaced by the ram into the opening; and transfer means for shifting each filled cup lifted to the position out of the gate.

According to the invention, therefore, the lifting ram of the improved packaging apparatus, which can be composed of a multiplicity of stations as in the aforedescribed French application or my above mentioned United States application, will have a substantially more limited stroke so that each cup, as it is lifted from the conveyor, is lifted only into a position in which it substantially obstructs the gate opening, the previously lifted cup which had substantially filled that opening earlier being thereby lifted in turn by the newly lifted cup so that it can be engaged by the gripper and transferred out of alignment with the opening.

With the mechanism of the invention, therefore, a substantial improvement of the operation of a sterile tunnel packaging machine can be obtained, especially when the cup has a projecting lid rim extending all around the cup, since this rim can be closely spaced from the wall of the opening and thereby prevent any excessive flow cross section from developing, even when a new filled cup is lifted into the opening.

Consequently, the lifting of a cup into the opening forms a new obstruction in the latter, while a cup previously held in the opening is simultaneously lifted there-from without enlarging the flow cross section for the sterile air.

As a consequence, the sterile air pressure remains substantially constant so that measurements can be effectively taken. The sterility of the system is not adversely effected. Energy consumption is reduced. Noise levels can be reduced as well. Indeed, the air consumption is drastically reduced to about 20 to 25% of the air quantity previously required.

Preferably the transfer mechanism is formed as a gripper system. A gripper system allows each cup in a waiting position within the gate to be securely and reliably engaged by a gripper, removed from the gate and transported away, e.g. on a removal conveyor on which the gripper deposits the cup. Means can be provided for raising and lowering the gripper and for shifting it substantially horizontally.

The holding position of the cup or the like in the outlet gate can be provided by retaining fingers which are deflected outwardly by the lifted cup and which can be biased inwardly by gravity, springs or the like to engage below the rim.

These fingers can be swingably mounted in slit-like recesses of a collar or holding body defining the passage of the gate and fixed on a wall of the tunnel.

A plurality of such gates can be provided one alongside another transversely of the longitudinal dimension of the tunnel and each gate can have a respective lifting ram and gripper system. The lifting rams can be engaged by a transversely extending carrier and the gripper tongs of the gripper systems can be interconnected by at least one pivot shaft.

BRIEF DESCRIPTION OF THE DRAWINGS

The above and other objects, features and advantages of my invention will become more readily apparent from the following description, reference being made to the accompanying highly diagrammatic drawing in which.

SPECIFIC DESCRIPTION

Figure 1:
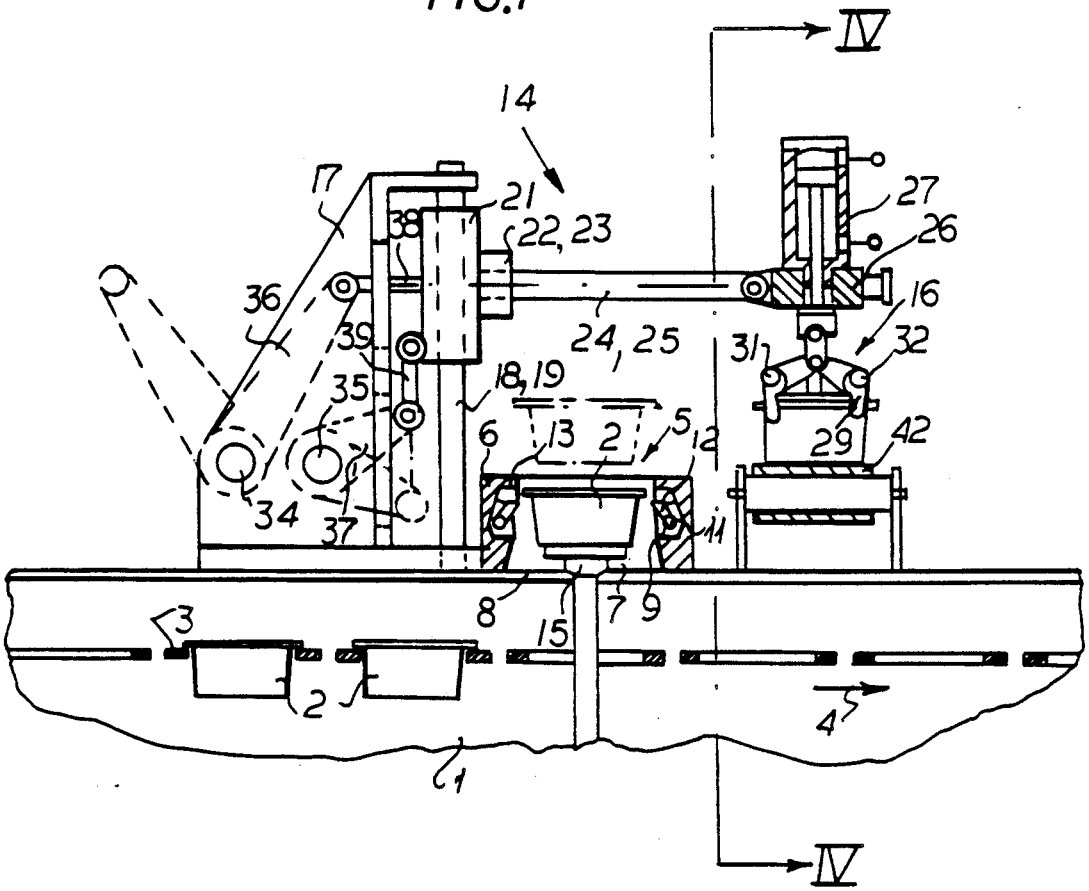
FIG. 1 is a cross sectional view through a portion of a filling and package closing machine taken along the line I—I of FIG. 2.

The only part of the filling and package-closing machine which has been illustrated in the drawing is the downstream end thereof at which filled cups 2 or the like appear. Upstream of the portion illustrated, of course, are the filling and closing stations of the machine as described.

The filled cups 2 or the like are displaced by a cup transporter or conveyor in the form of a cell chain 3 in the direction of arrow 4 through a sterile tunnel 1 maintained at superatmospheric pressure with sterile air.

At the outlet end of the sterile tunnel 1, an outlet gate 5 is provided which, in the illustrated embodiment, is formed by a collar or holding body 6 with a throughgoing passage or opening 7.

The passage 7 which preferably has a slightly conical configuration, registers with a throughgoing opening 8 in the wall of the sterile tunnel 1.

In the collar 6 circumferentially spaced slit-like recesses 9 are provided to receive holding fingers 12 pivotable about axes 11. Yieldably biasing those fingers outwardly are springs 13 or the like.

The outlet gate 5 is aligned with a lifting device 14 comprised of a lifting ram 15 and a gripper system 16. The lifting ram 15 can be raised and lowered by a drive which has not been illustrated within the sterile tunnel and with a limited stroke.

A support frame 17 is mounted on the wall of the sterile tunnel 1 and is provided with two vertical guide block 21, two horizontal guide rods 24 and 25 are received which slidably carry at their opposite ends a support body 26 forming a gripper head.

The support body 26 of the gripper head is provided with a piston-end-cylinder unit 27 whose piston rod 28 is connected to the gripper tongs 29 for raising and lowering same. The gripper tongs 29 can be opened and closed by the back and forth swing of pivot shafts 31 and 32 via a lever system 33.

In the support frame 17, two horizontally oriented journal shafts 34 and 35 are rotatable, the one carrying a pivot lever 36 while the other carries a pivot lever 37. The pivot lever 36 is connected by a tension rod 38 with the body 26 while the swing lever 37 is connected by a connected rod 39 to the slide block 21. The shaft 34 and 35 can be angularly displaced by a drive not shown.

Figure 2:
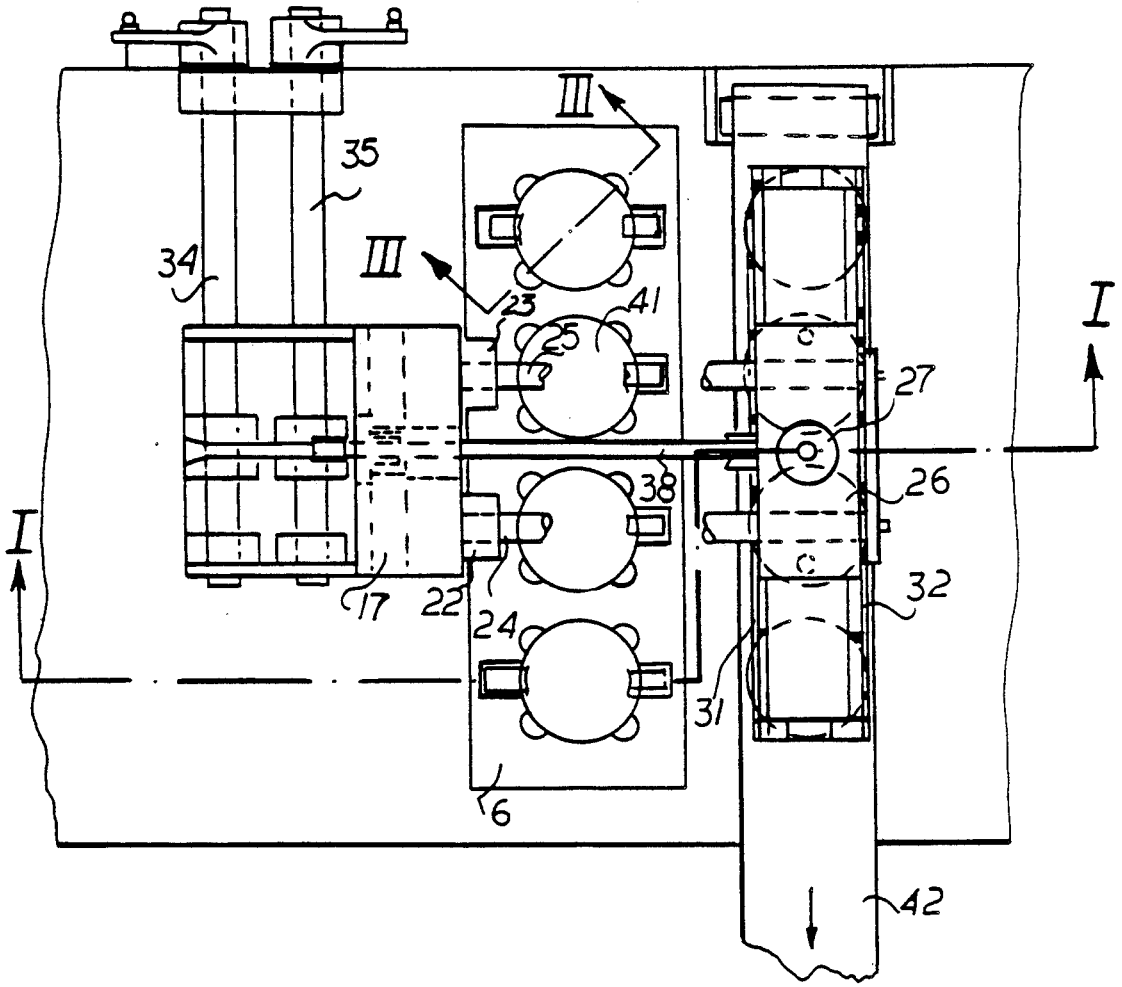
FIG. 2 is a plan view of the portion of the machine shown in FIG. 1.
Figure 3:
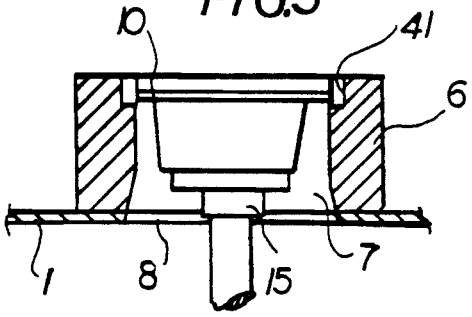
FIG. 3 is a section taken along the line III—III of FIG. 2.
Figure 4:
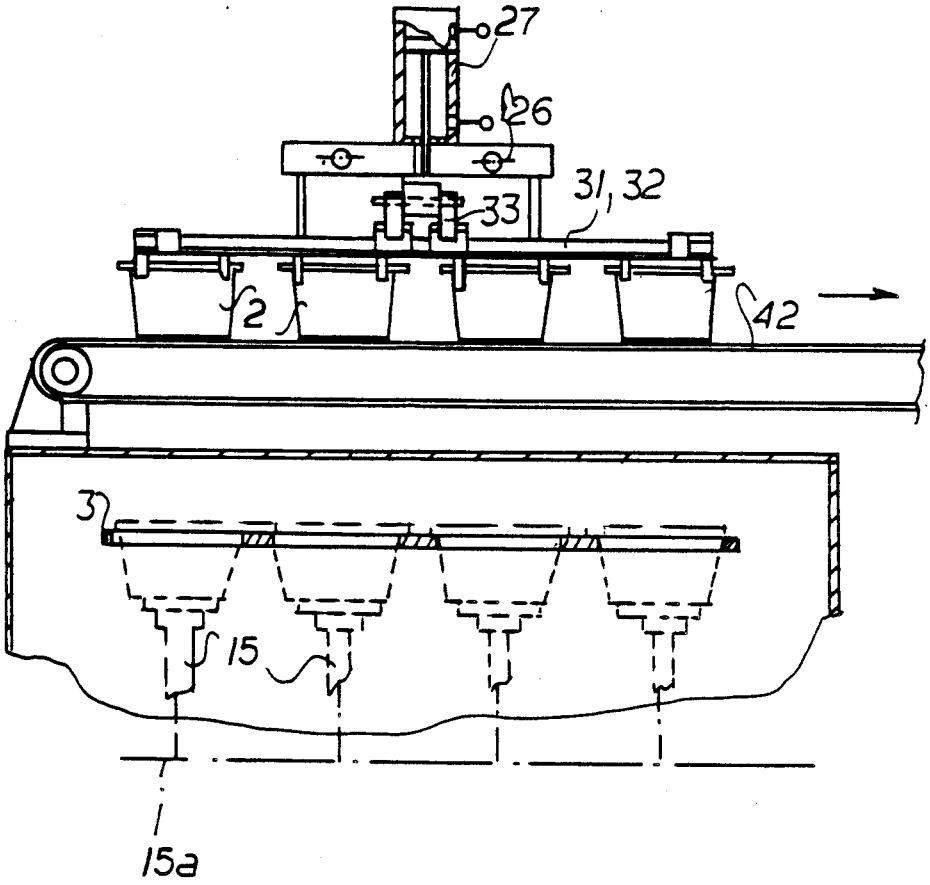
FIG. 4 is a section taken along the line IV—IV of FIG. 1.

As is apparent from FIGS. 2 and 4, the cell chain 3 can be provided with four cup rows disposed one alongside the other and each of which is associated with a respective gate 5, a respective lifting ram 15 and a respective gripper 29. For the common and simultaneous actuation of all grippers 29, these are connected by the pivot shafts 31 and 32 with one another while the lifting rams 15 are provided with a common carrier shown only diagrammatically by the dot-dash line 15*a* in FIG. 4.

At the discharge end (upper end) of the passage 7, semicircular recesses 41 are provided in circumferentially spaced relationship. The significance of these recesses will be developed below.

Above the sterile tunnel 1 and laterally offset from the gates, a transport conveyor 42 is provided to carry away the filled cups.

The lift station in the region of the outlet gate 5 of the packaging machine operates in the following manner.

As soon as the cell chain 3 carries a row of cups below the respective outlet gates 5, the cups 2 are raised by the rams 15 until each cup deflects the fingers 12 which then engage below the covers 10 of the cups to support the cups in the passage 7. The rams can then be lowered and the cell chain 3 advanced by the next step so that this process is repeated and the cups from the nest row are raised. Simultaneously the grippers are displaced into the region of the gates 5 by a corresponding pivoting of the levers 36 and 37 and by actuation of the piston-end-cylinder unit 27 so that the grippers can engage through the recesses 41 the edges of the cover rims 10 and enable lifting of the cups. The reverse movements of the swing levers 36 and 37 displace the grippers with the cups carried thereby to the conveyor belt 42 on which the cups are deposited. Because of the simultaneous withdrawal of a cup and the lifting of a cup into each passage 7, the passages 7 remain substantially closed so that the sterile air pressure remains constant. The limited stroke of the rams 15 may be sufficient to lift a cup previously held in each passage by the fingers 12 until the fingers engage below the newly lifted cup. Hence the ram never passes out of the passage and can never entrain microorganisms from the exterior into the tunnel.

The transfer mechanism need not be constituted by a gripper system but can also be a worm or other conveyor capable of displacing the cups lifted from the passage by the next cup.

I claim:

1. A packaging machine for aseptic packaging of a sterile filling into cups, comprising:

means for defining a sterile tunnel maintained at a superatmospheric pressure of sterile air and through which filled cups are displaceable to a discharge end of said tunnel;

a cup conveyor displaceable in said tunnel for carrying said filled cups to said discharge end;

an outlet gate formed above said conveyor at said outlet end having an opening dimensioned to pass a filled cup but to be substantially blocked by a filled cup in said opening;

a lifting ram in said tunnel aligned with said opening for lifting filled cups in succession from said conveyor into said opening, said lifting ram having a stroke limited to enable each filled cup removed from said conveyor to be lifted into said opening to thereby substantially block said opening while a filled cup previously retained in said opening is lifted to a position above the filled cup substantially blocking said opening;

means for releasably retaining the filled cup substantially blocking said opening in said opening until another filled cup is displaced by said ram into said opening; and transfer means for shifting each filled cup lifted to said position out of said gate.

2. The machine defined in claim 1 wherein said transfer means includes a gripper engageable with a filled cup in said position and carrying it into another position spaced from said gate.

3. The machine defined in claim 2 wherein said transfer means includes means for raising and lowering said gripper and for displacing said gripper substantially horizontally.

4. The machine defined in claim 3 wherein said means for releasably retaining the filled cup includes a plurality of retaining fingers biased into a path of the filled cups through said gate and supporting a filled cup in said opening.

5. The machine defined in claim 4 wherein said gate is formed by a collar having a passage defining said opening and formed with slit-like recesses opening into said passage, said retaining fingers being swingably mounted in said recesses.

6. The machine defined in claim 5 wherein said collar is formed with additional generally semicircular recesses.

7. The machine defined in claim 3 wherein said passage is conical at least over a portion of a length thereof.

8. The machine defined in claim 3 wherein said transfer means includes a support, vertical and horizontal guide rods on said support, a slide block guided on said vertical guide rod, said gripper being provided on a gripper head, a pair of pivot shafts journaled on said support and provided with respective swingable levers, and respective traction rods pivotally connected to said levers, one of said traction rods being pivotally connected to said block for displacing same, another of said traction rods being connected to said gripper head.

9. The machine defined in claim 8 wherein said gripper head is provided with at least one pair of gripper tongs and a piston-and-cylinder unit operatively connected with said gripper tongs for opening and closing same.

10. The machine defined in claim 9 wherein said tunnel is formed with a plurality of said gates disposed substantially adjacent one another, each associated with a respective one of said rams and a respective one of said grippers.

11. The machine defined in claim 10 wherein said rams are interconnected by a respective transverse bar and said grippers are interconnected by a transverse bar.

12. The machine defined in claim 11, further comprising another conveyor at said other position for receiving said filled cups from said grippers and transporting said filled cups away from said gates.

13. The machine defined in claim 12 wherein said means for releasably retaining the filled cup includes a plurality of retaining fingers biased into a path of the filled cups through said gate and supporting a filled cup in said opening.

14. The machine defined in claim 13 wherein said gate is formed by a collar having a passage defining said opening and formed with slit-like recesses opening into said passage, said retaining fingers being swingably mounted in said recesses.

15. The machine defined in claim 3 wherein said tunnel is formed with a plurality of said gates disposed substantially adjacent one another, each associated with a respective one of said rams and a respective one of said grippers.

16. The machine defined in claim 15 wherein said rams are interconnected by a respective transverse bar and said grippers are interconnected by a transverse bar.

17. The machine defined in claim 16, further comprising another conveyor at said other position for receiving said filled cups from said grippers and transporting said filled cups away from said gates.

18. The machine defined in claim 17 wherein said means for releasably retaining the filled cup includes a plurality of retaining fingers biased into a path of the filled cups through said gate and supporting a filled cup in said opening.

19. The machine defined in claim 3 wherein said tunnel is formed with a plurality of said gates disposed substantially adjacent one another, each associated with a respective one of said rams and a respective one of said grippers.

20. The machine defined in claim 3, further comprising another conveyor at said other position for receiving said filled cups from said gripper and transporting said filled cups away from said gate.

* * * * *